US006161942A

United States Patent [19]

Liu

[11] Patent Number: 6,161,942

[45] Date of Patent: Dec. 19, 2000

[54] COUPLING MECHANISM USED FOR MOUNTING DECORATIVE LIGHT BULB SETS ON A BOARD

[76] Inventor: Chun Ming Liu, No. 430, Ko Fong Road, Hsinchu, Taiwan

[21] Appl. No.: 09/270,205

[22] Filed: Mar. 15, 1999

[51] Int. Cl.[7] ..... F21V 21/00

[52] U.S. Cl. ..... 362/249; 362/396; 362/806

[58] Field of Search ..... 362/396, 806, 362/249, 252, 226

[56] References Cited

U.S. PATENT DOCUMENTS 6,068,389 5/2000 Lai ..... 362/396

*Primary Examiner*—Thomas M. Sember

*Attorney, Agent, or Firm*—Rosenberg, Klein & Lee

[57] ABSTRACT

The present invention relates to a coupling mechanism used for mounting decorative light bulb sets on a board. The coupling mechanism consists of a mounting board with a plurality of light bulb holder bases and a pair of clasp hooks formed on the light bulb holder of each decorative light bulb set. The coupling mechanism enables a light bulb holder to be easily snapped in a light bulb holder base of the mounting board. In this way, users can arrange a plurality of decorative light bulb sets to form a planar pattern. When these decorative light bulbs are turned on, they shine to show a desired figure or image, resulting in a decorative effect.

3 Claims, 4 Drawing Sheets

COUPLING MECHANISM USED FOR MOUNTING DECORATIVE LIGHT BULB SETS ON A BOARD

BACKGROUND OF THE INVENTION

Using the illumination of miniature light bulb series to achieve a decorate effect has been known. However, to dispose light bulb series in a predetermined pattern, the prior art means adopted a support post (2) to receive light bulb holders (3). As shown in FIG. 1, the combination of a light bulb holder (3) with a support post (2) according to the prior art structure is obtained by means of extending two hook-like arms (11) and (12) of an annular retaining element (1) into an opening (21) formed on the support post (2). When those light bulbs are lit up, a preset image or pattern appears. The shortcoming adhered to such an arrangement is an insufficient bonding strength between the annular retaining element (1) and the light bulb holder (3). Thus it often happened that light bulb series got out of position. Furthermore, the connection wires of light bulb series often scattered over a large area without any fixing, which is detrimental to the decorative effect and may bring an unpleasant accident.

In view of the above problems, the primary object of the invention is to provide a coupling mechanism in which the shortcomings in a conventional structure are eliminated and that can enhance the decorative illumination effect of miniature light bulbs by means of integrated planar arrangements including light bulbs and electrical wires. Now the features and advantages of the invention will be described in more detail with reference to the accompanying drawings.

BRIEF DESCRIPTION OF THE ACCOMPANYING DRAWINGS

DETAILED DESCRIPTION OF PREFERRED EMBODIMENTS

Figure 1:
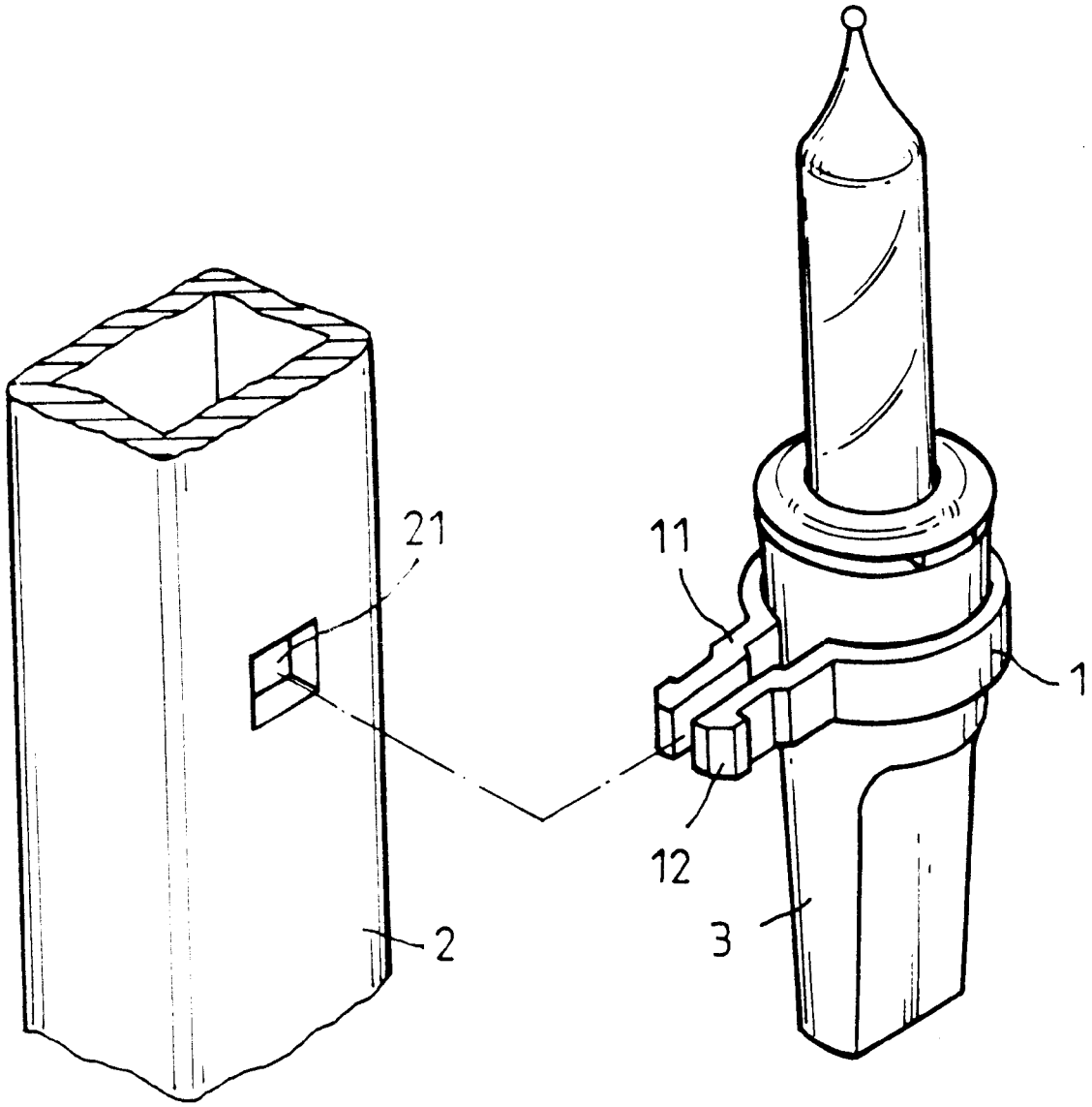
FIG. 1 (prior art)
FIG. 1 is an exploded view showing a prior art structure used for coupling a miniature decorative light bulb with a support post.
Figure 2:
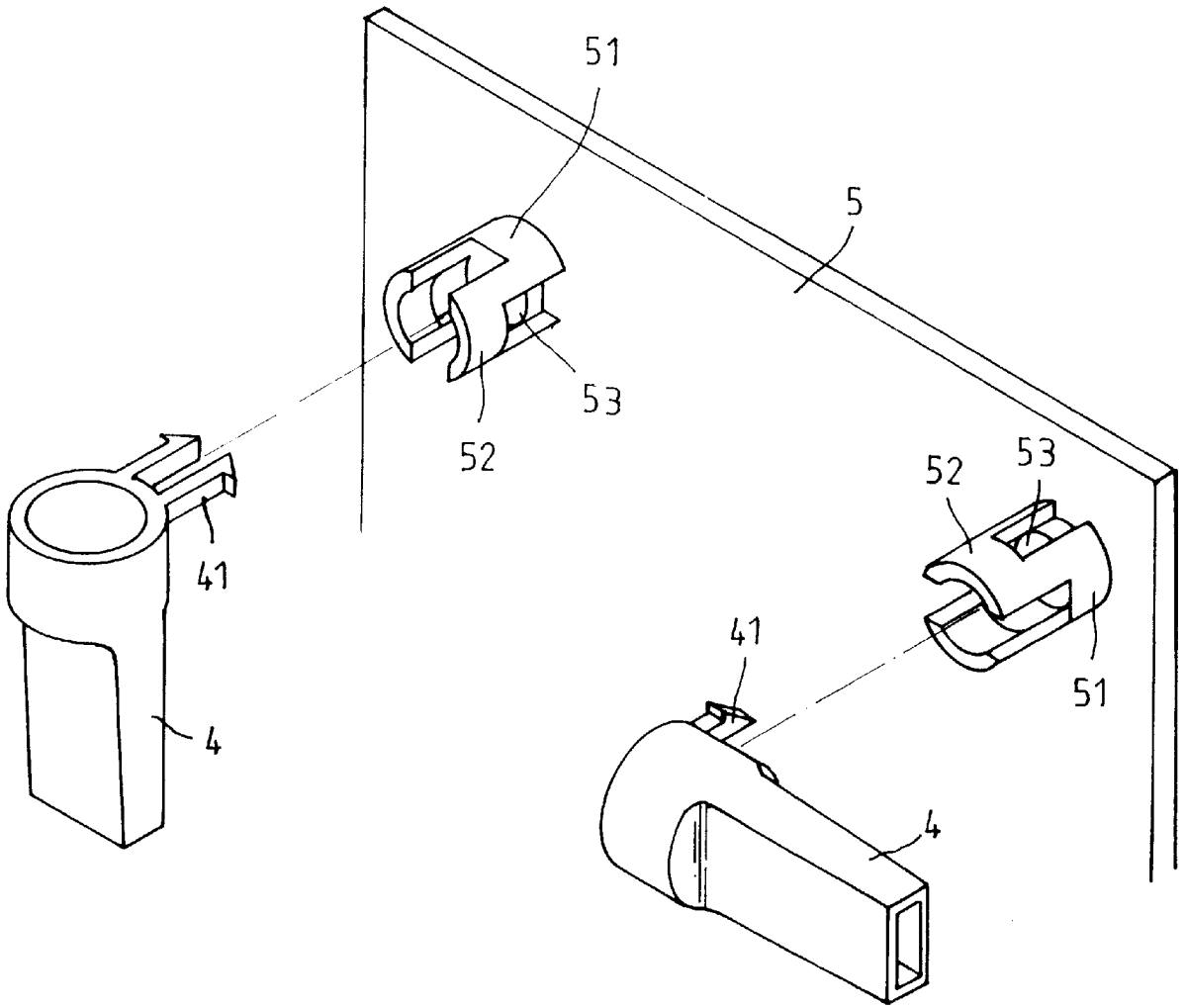
FIG. 2 is an exploded view illustrating an embodiment of the coupling mechanism according to this present invention
Figure 3:
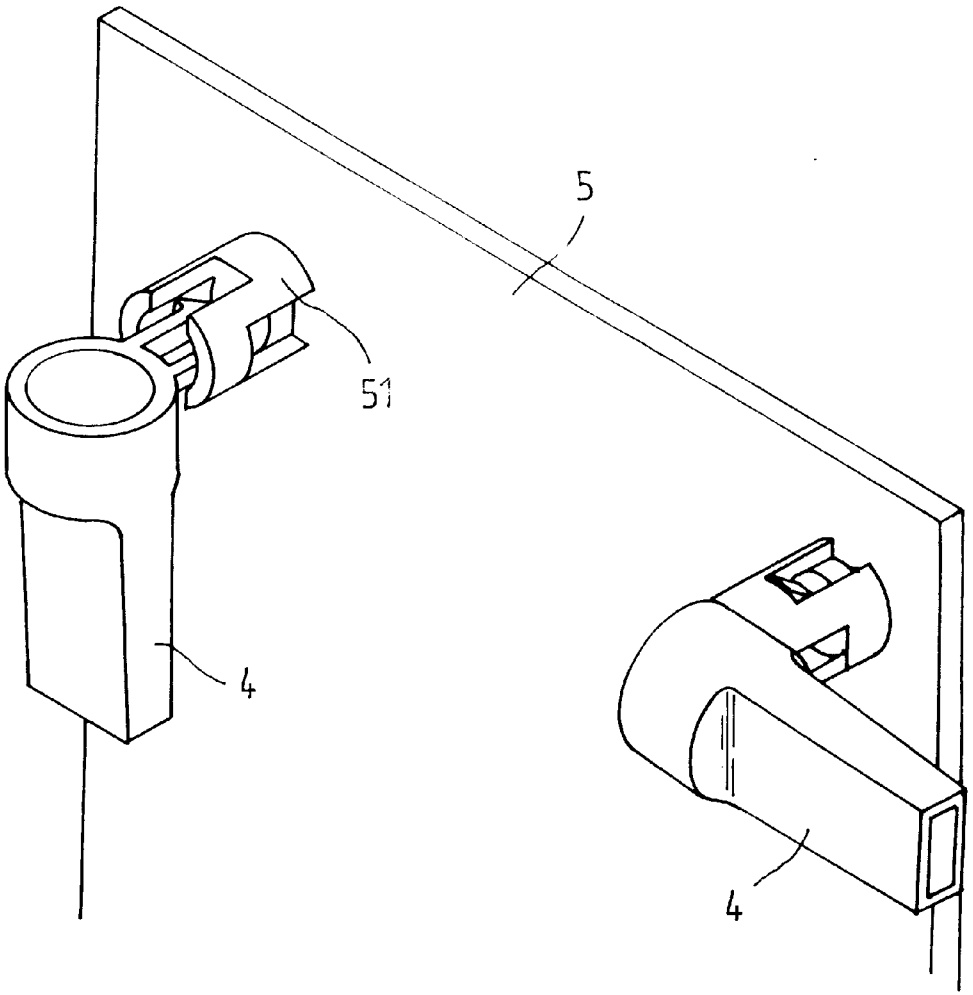
FIG. 3 is a perspective view indicating how a decorative light bulb of FIG. 2 is assembled with a board according to the present invention.
Figure 5:
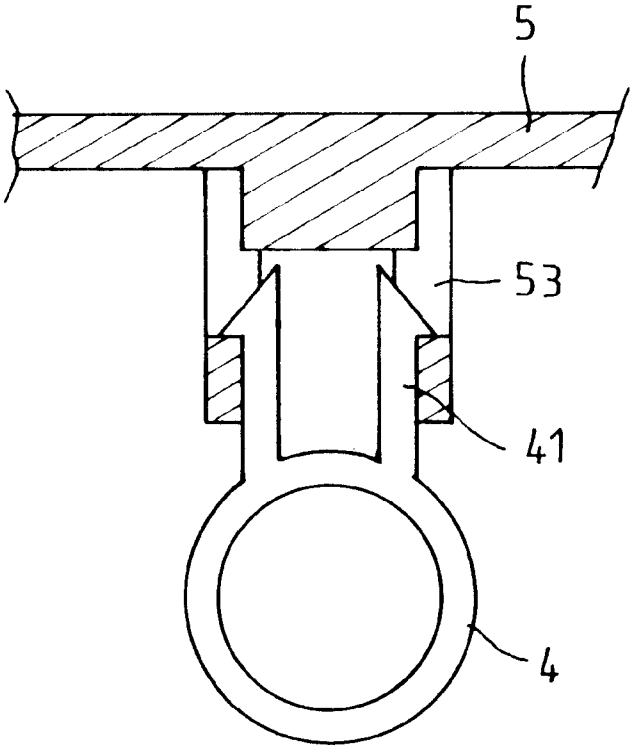
FIG. 5 depicts a miniature light bulb holder secured on a holder base of the mounting board according to the present invention.
Figure 4:
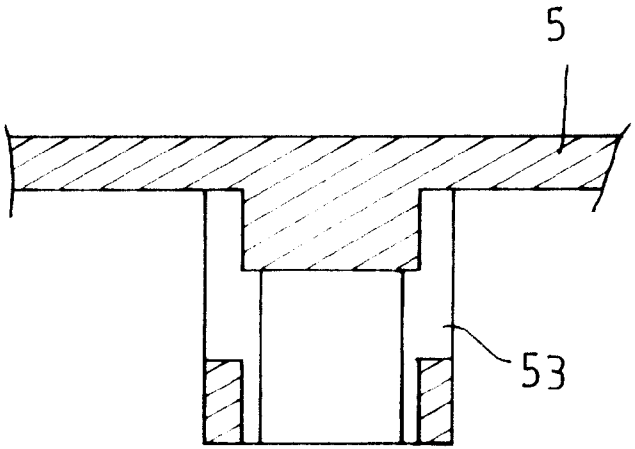
FIG. 4 is a partial cross sectional view of the mounting board of the invention.

Referring to FIGS. 2 through 5, the invention is an innovative coupling mechanism used for decorative light bulbs. It includes a mounting board (5) that can be of any desired shape and that is provided thereon with light bulb holder bases (51) arranged to form a predetermined figure or pattern. Each light bulb holder base (51) has two outwardly protrusive arc-shaped arms (52) disposed on two opposite sides. Each arc-shaped arm (52) is provided on the lower portion with a retaining groove (53). The light bulb series according to the invention consist of miniature light bulbs on a special designed lamp holder (4). Each lamp holder (4) has a pair of clasp hooks (41) on one side thereof. Thus the light bulb holder (4) can be easily snapped in a holder base (51) by engaging the clasp hooks with the retaining grooves (53). In this way, light bulb holders (4) can be quickly mounted on a mounting board (5). Furthermore, the inclination variation of two arc-shaped arms (52) of a holder base (51) can change the orientation of a light bulb holder (4) on the mounting board and so users can create assorted fascinating illumination images by means of various combinations of light bulb holders (4) with holder bases (51). Consequently the invention has the advantage of enhancing the decorative effect of light bulb series.

Besides, when mounting a light bulb holder (4) in a holder base (51), users can dispose electrical wires between two arc-shaped arms (52). After the light bulb holder (4) is secured in a holder base (51), the electrical wires will be automatically held in position. Thus the invention can eliminate the shortcomings of a prior art structure.

From the above description, the unique coupling mechanism according to the invention evidently has innovations in structure and practical value in industry. Therefore, we hereby file an application of a patent.

What is claimed is:

1. A coupling mechanism for mounting decorative light bulbs comprising:

a lamp holder having a pair of sliding jaws projecting therefrom, said pair of sliding jaws having a gap formed therebetween, each of said sliding jaws having a bevel hook formed on a tip thereof;

a holder base having a pair of arms projecting therefrom, each of said arms having a retaining hole formed therethrough, wherein said pair of sliding jaws are inserted between said pair of arms with said bevel hooks providing engagement with said arms by insertion into said retaining holes thereby allowing said lamp holder to be held in a fixed position with respect to said holder base, said holder base being mounted on a mounting board.

2. The coupling mechanism for mounting decorative light bulbs as recited in claim 1, wherein said holder base on said mounting board is arranged in a predetermined position.

3. The coupling mechanism for mounting decorative light bulbs as recited in claim 1, wherein a set of electrical wires are disposed between said pair of arms of said holder base and secured therein by said lamp holder and said holder base.

* * * * *